US006658907B2

(12) United States Patent
Inoue et al.

(10) Patent No.: US 6,658,907 B2
(45) Date of Patent: Dec. 9, 2003

(54) METHOD OF SHOT PEENING PROCESSING AND ARTICLE PROCESSED THEREBY, AND PEENING MATERIAL AND USE THEREOF

(75) Inventors: Akihisa Inoue, Kawanaijutaku 11-806 35, Motohasekura, Kawanai, Aoba-du, Sendai-shi, Miyagi-ken (JP); Junkou Kurosaki, Aichi-ken (JP); Kiyoshi Okumura, Aichi-ken (JP); Kouji Kajita, Aichi-ken (JP)

(73) Assignees: Sintokogio, Ltd., Aichi-ken (JP); Sintobrator, Ltd., Aichi-ken (JP); Akihisa Inoue, Miyagi-ken (JP)

( * ) Notice: Subject to any disclaimer, the term of this patent is extended or adjusted under 35 U.S.C. 154(b) by 0 days.

(21) Appl. No.: 10/089,441

(22) PCT Filed: Jul. 31, 2001

(86) PCT No.: PCT/JP01/06585

§ 371 (c)(1),
(2), (4) Date: Jun. 20, 2002

(87) PCT Pub. No.: WO02/09908

PCT Pub. Date: Feb. 7, 2002

(65) Prior Publication Data

US 2003/0005736 A1 Jan. 9, 2003

(30) Foreign Application Priority Data

Jul. 31, 2000 (JP) ..... 2000-230317

(51) Int. Cl.[7] ..... B24C 11/00; C21D 8/00

(52) U.S. Cl. ..... 72/53; 29/90.7; 451/39

(58) Field of Search ..... 72/53; 29/90.7; 451/39, 40

(56) References Cited

U.S. PATENT DOCUMENTS 5,409,415 A * 4/1995 Kawanami et al. ..... 451/39
6,346,157 B1 * 2/2002 Takezawa et al. ..... 72/53
6,394,881 B1 * 5/2002 Watanabe et al. ..... 451/39

* cited by examiner

*Primary Examiner*—David Jones
(74) *Attorney, Agent, or Firm*—Finnegan, Henderson, Farabow, Garrett & Dunner LLP

(57) ABSTRACT

A method for shot peening wherein peening shot having a Vickers hardness (Hv) in the range of 900–1100 and a Young's modulus of 200,000 MPa or less, is used, and wherein a treated article is obtained by such a method that has a maximum residual compressive stress of 1600 MPa or more and a surface roughness of 5 microns or less.

11 Claims, No Drawings

METHOD OF SHOT PEENING PROCESSING AND ARTICLE PROCESSED THEREBY, AND PEENING MATERIAL AND USE THEREOF

FIELD OF THE INVENTION

This invention relates to a method for the treatment of shot peening and a treated article obtained by the process.

DESCRIPTION OF THE RELATED ART

It is conventionally known that to lengthen the life cycle of a metal product, a metal substance is to be treated by shot peening. A variety of materials are known as the peening materials used for the shot peening; however, among them a peening material made of cast steel has been conventionally and widely used. This peening material made of cast steel can give a high residual compressive-stress to the metal substance by increasing the speed of peening. However, there had been a problem in that due to the increased speed of peening, the surface of the metal substance might be damaged.

When the surface hardness of the metal substance is increased by heat treatment, it is difficult to give it a high residual compressive-stress by increasing the speed of peening to the-maximum. This is because the peening material is crushed. For this reason, the cases have been increasing where a peening material made of cemented carbide is used. (For example, see the Gazette of Japanese Patent Early-publication No. Hei. 08-323626.) When the peening material made of cemented carbide is used, a metal substance having a high surface hardness can be provided with a high residual compressive-stress. But, still in this case there is a problem in that the surface of the metal substance can be sometimes damaged.

A so-called treatment of double peening, which at first treats a metal substance with the peening material having a larger diameter, then treats it with the peening material having a smaller diameter, is a commonly used technique. But, there has been a problem in that plural peening equipment is indispensable for it. Proposed is a so-called mixed peening, which peens a metal substance by using a peening material having a larger diameter and a peening material having a smaller diameter. However, this technique has a variety of unsolved problems, such as the mixing ratio of the two peening materials, the control of the grain size, and the like, and it has not led to a practical use.

SUMMARY OF THE INVENTION

This invention has been accomplished to solve the above problems. The invention provides a method for the treatment of shot peening that provides a metal substance having a relatively high hardness as well as a low hardness, and with a high residual compressive-stress, and readily provides a smaller surface roughness of a treated article. The invention also provides a treated article obtained by this method. The invention further provides a peening material and a method of its use.

The invention aims to solve the problems in the conventional treatment of shot peening from the aspect of the peening material. The inventions comprise the following inventions, 1–8.

1) One of the methods for the treatment of shot peening of the invention is characterized in that a peening material having a Vickers hardness (Hv) in the range of 900–1100 and a Young's modulus of 200,000 MPa or less (more preferably a Young's modulus in the range of 50,000–150,000 MPa) is used.
2) One of the methods for the treatment of shot peening in the invention is characterized in that an iron-based amorphous spherical particle is used as a peening material having a Vickers hardness and Young's modulus in the above ranges.
3) One of the methods for the treatment of shot peening of the invention is characterized in that by using the peening material (more preferably the iron-based amorphous spherical particle) having a Vickers hardness and Young's modulus in the above ranges, a substance having a Vickers hardness of 950 or less (more preferably in the range of 650–950) is subject to the treatment of shot peening.
4) One of the methods for the treatment of shot peening of the invention is characterized in that by using a peening material having a Vickers hardness and Young's modulus in the above ranges, the above substance is treated by peening at a speed of peening of 100 m/s or less (more preferably 50–70 m/s).
5) One embodiment of the invention is a method of treating a substance made of steel having a Vickers hardness of 950 or less by shot peening, wherein the process is carried out by using an iron-based amorphous spherical particle as a peening material, so that the treated article has the characteristics of a maximum residual compressive-stress of 1600 MPa or more, and a surface roughness of 5 $\mu$m or less.
6) A treated article of the invention is a material treated by any one of the above methods.
7) A peening material of the invention is one having a Vickers hardness in the range of 90–1100 and a Young's modulus of 200,000 MPa or less (preferably an average particle diameter of 0.02 to 1.5 mm).
8) One of the methods of using a peening material in the invention is one that uses a peening material having a Vickers hardness in the range of 900 to 1100 and a Young's modulus of 200,000 MPa or less for the treatment of shot peening.

DETAILED EXPLANATION OF THE INVENTION

In the invention, "substance" means the material or the part made of metal that is to be subject to the treatment of shot peening. In the invention, a "treated article" means the substance which has been subject to the treatment of shot peening of the invention.

As in this invention, "shot peening" is well known to one skilled in the art. It is a kind of cold-work, and means an improvement of the mechanical properties of the substance.

As for the peening material used in the invention, iron-based amorphous metals are given. Among them, an iron-based amorphous spherical particle is preferable for the peening material of the invention because it can be manufactured relatively easily and at lower cost than in the conventional method.

The average diameter of the iron-based amorphous spherical particle used in the invention is not specifically limited. But, if the average diameter is in the range of 0.05–0.5 mm, the amorphous peening material having a Young's modulus of 50,000–150,000 can be manufactured by the Atomize method at relatively lower cost. If the average diameter of the particle is in the range of 0.05–0.3 mm, it can be manufactured more easily. However, if the average diameter of the particle is from 0.02 to 1.5 mm, it can still be manufactured. As the particle diameter becomes larger, it gets increasingly difficult to obtain spherical amorphous particles. When the diameter is greater than 1.5 mm, it is difficult to have the shape of it be spherical. Thus, it is further preferable that the average diameter of the peening material used in the invention be 0.05 mm to 1.5 mm.

It is preferable that the content of iron in the iron-based amorphous spherical particle used in the invention be 45 to 55 wt %. Also, the iron-based amorphous spherical particle used in the invention may comprise other metals. It may comprise, for example, nickel, cobalt, or the like.

As for the substance used in the invention, one having a Vickers hardness of 950 or less before the treatment of shot peening is preferable. For such hardness, by the treating process of the invention, the substance can be provided with a high residual compressive-stress, and a small surface roughness thereof can be achieved. On the other hand, even if the Vickers hardness of the substance is 650 or less, an effect similar to the above can be obtained. However, such a substance can be provided with a residual stress not based on the method of the invention, namely, by using a peening material of another type of material.

As for the substance used in the invention, carburized parts like a gear and a variety of molds, for example, fall under it. As for a material of it, for example, SKD, SUP, SCM, SNCM (by the Japanese Industrial Standards), and the like are given. Also, the shape of the substance is not limited, and, further, whether it is treated by heat, and the types of heat treatment, are not limited.

In this invention, the speed of peening is a concept which includes the speed of projection by a variety of air-operated projection equipment as well as the speed of peening by a centrifugal peening. The speed of peening of 50–70 m/s is less than a normal centrifugal speed of peening. As for a method to carry out the treatment of peening, a pressure-type and gravity-type are given. Both methods can be used in the invention.

As examples of the other projection conditions, a projection pressure of 0.3 MPa, a distance for the projection of 1500 mm, and a projected amount of 4 kg/min., are given. These are representative examples when the invention is applied for a spring. It is to be appreciated by one skilled in the art that it is not intended to limit the scope of the invention to these examples.

THE EFFECTS OF THE INVENTION

According to invention Nos. 1 and 2, a treated article having a high residual compressive-stress and a small surface roughness can be obtained, and the life cycle of such a treated article is long.

If the substance is subject to the treatment of shot peening of invention No. 2, the treated article has a high residual compressive-stress, with the surface roughness thereof being controlled below a constant value (the softness is maintained), because the particle as the peening material is different from the particle of the crystal structure, and is a material with a low modulus (a low Young's modulus). That is to say, while maintaining the softness of the surface, increases of the hardness, yield strength, and tensile strength can be achieved.

Also, according to invention No. 2, because the hardness of an iron-based amorphous particle is high, a desirable blast treatment can be efficiently carried out.

Additionally, according to invention No. 3, when the substance having a Vickers hardness of 950 or less (e.g., a steel) is treated by shot peening, the treated article can be easily provided with the characteristics of a maximum residual compressive-stress of 1600 MPa or more, and a surface roughness of 5 microns or less.

Also, according to invention No. 4, even at a relatively low speed of peening the treated article can be provided with the characteristics of a maximum residual compressive-stress of 1600 MPa or more, and a surface roughness of 5 micorns or less. Thus, invention No. 4 is a method for the treatment of shot peening that contributes to saving energy. However, by the invention the surface roughness can be lowered even at a high speed of peening.

According to invention No. 5, the steel can be provided with the characteristics of a maximum residual compressive-stress of 1600 MPa or more, and a surface roughness of 5 microns or less, and the life cycle of the treated article made of steel is extended.

As is evident from the above explanation, this invention is a method for the treatment of shot peening wherein a peening material having a Vickers hardness (Hv) in the range of 900–1100 and a Young's modulus of 200,000 MPa or less is used. By this method, even if steel having high hardness is used as the substance, it becomes possible to provide the substance with the property of a high residual compressive-stress, while controlling the surface roughness thereof to be below a constant value.

If it is desired to provide a high residual compressive-stress, generally a substance of which the hardness is higher than that of the peening material may be selected as the substance. However, when a particle with high hardness, such as a cemented carbide, is used, the surface of the substance, which then becomes the treated article, will be tremendously damaged due to the high modulus thereof. But, an amorphous shot-peening material has a high hardness and a low modulus (low Young's modulus). Thus, by the peening, treatment using the amorphous shot-peening material, the substance can be provided with a high residual compressive-stress, without damaging the surface thereof.

EXAMPLES

Below some embodiments of the invention are now illustrated by giving some test examples.

Test Example 1

In Test 1, the effect in which an iron-based amorphous particle was adopted as a peening material was studied. The iron-based amorphous particle, of which the composition of the material is 6% cobalt, 25% nickel, 5% silicon, 3% boron, 4% molybdenum, and 57% (the remainder) iron, having a Vickers hardness of 900 to 1000, a Young's modulus of 80,000 MPa, and a particle diameter of 0.3 mm, was used. The peening material used as the cemented carbide shot was made of tungsten carbide, having a Vickers hardness of 1400, a Young's modulus of 600,000 MPa, and a particle diameter of 0.3 mm. The peening material used as the cast steel shot was made of carbon steel, having a Vickers hardness of 730, a Young's modulus of 210,000 MPa, and a particle diameter of 0.3 mm. As the blast equipment, "Air Blast Equipment MY30," from Sinto Brator Ltd., was used. As the substance, a mold made of SKD 11, the composition of which is 1.5% carbon, 12% chrome, 1% molybdenum, and 85.5% (the remainder) iron, having a Vickers hardness of 770, was used. The adopted conditions of the treatments are: the pressure of the projection: 0.4 MPa; the nozzle diameter of the projection: 6 mm; the distance for the projection: 150 mm; the amount of the projection: 80 m/min. The treatment of shot peening was carried out. The results are, listed in Table 1.

TABLE 1

| | | Vickers hardness of the treated article | Surface roughness of the treated article | Max. residual compressive-stress of the treated article |
|---|---|---|---|---|
| Ex. | amorphous shot | 900 | 2.702 | 1900 |
| | amorphous shot | 900 | 2.546 | 1850 |
| | amorphous shot | 950 | 3.123 | 1850 |
| | amorphous shot | 1000 | 3.416 | 1800 |
| Com. Ex. | cemented carbide shot | 1400 | 8.042 | 1950 |
| | cast steel shot | 730 | 1.261 | 1500 |

From Table 1, the following is understood. By the cast steel shot that uses a peening material made of cast steel, although the surface roughness of the treated article was small, the treated article was not given a high residual compressive-stress. On the other hand, to provide the treated article with a high residual compressive-stress, peening material made of cemented carbide was used. But, the surface roughness thereof became very high. On the contrary, "amorphous shot" that uses peening material made of iron-based amorphous was able to have a residual compressive-stress for the treated article that is high, and the surface roughness thereof low.

Test Example 2

Next, Test Example 2 is explained. To study the effects of the types of peening material and speed of peening (speed of projection) in the peening treatment, spring material SCM420, the composition of which is 0.2% carbon, 0.25% silicon, 0.75% manganese, 1.1% chrome, 0.25% molybdenum, and the remainder iron, having an Hv of 370, was treated. The maximum residual compressive-stress and the surface roughness of the treated article were measured.

The amorphous peening material used in this test, the material of which was the same as that used in Test Example 1, had a Vickers hardness of 1000, a Young's modulus of 75,000 to 83,000 MPa, and a particle diameter of 0.05 to 1.5 mmϕ. The materials of the cast steel and cemented carbide peening materials are the same as those used in Test Example 1. The results are listed in Table 2.

TABLE 2

| Conditions of projection | | | | Result | | |
|---|---|---|---|---|---|---|
| Types of peening material | | | | | | |
| | Average diameter (mm) | Hardness (Hv) | Young's modulus (MPa) | Speed of peening (m/s) | Residual compressive stress (MPa) | Surface roughness Rz (micron) |
| Amorphous [spherical particles] | 0.05 | 1000 | 83,000 | 80 | 1600 | 2.5 |
| | 0.2 | 1000 | 80,000 | 80 | 1800 | 3.0 |
| | 0.5 | 1000 | 80,000 | 80 | 1900 | 4.0 |
| | 1.0 | 1000 | 78,000 | 80 | 1950 | 5.0 |
| | 1.5 | 1000 | 75,000 | 80 | 1950 | 6.0 |
| Cast steel | 0.2 | 800 | 210,000 | 100 | 1100 | 3.0 |
| | 0.3 | 800 | 210,000 | 100 | 1300 | 5.0 |
| | 0.3 | 800 | 210,000 | 120 | 1350 | 7.0 |
| | 0.6 | 800 | 210,000 | 100 | 1200 | 5.0 |
| Cemented carbide | 0.06 | 1500 | 600,000 | 40 | 1900 | 11.0 |
| | 0.2 | 1500 | 600,000 | 40 | 1900 | 13.5 |

It should be understood from Table 2 that when the amorphous spherical particle, i.e., the peening material that meets the requirements of the invention, was used, at a speed of peening lower than the one used in the case when a steel spherical shot (cast steel) was used, a high residual compressive-stress of 1600 MPa or more, which could not be provided when steel spherical shot was used, was able to be provided.

Further, based on the testing, it is clear that when the above amorphous spherical particle is used, the treatment can be carried out with less damage to the surface, compared to when the peening material of cemented carbide was used to provide a high residual compressive-stress. According to this invention, the surface roughness of the treated article becomes about 5 microns or less, which is generally required. Thus, it is not necessary to carry out a re-treatment such as grinding or the like.

What is claimed is:

1. A method for shot peening a metal substance, comprising projecting at a metal substance shot having a Vickers hardness (Hv) in the range of 900–1100 and a Young's modulus of less than or equal to 200,000 MPa.

2. The method of claim 1, wherein the shot has a Young's modulus in the range of 50,000–150,000 MPa.

3. The method of claim 1 or 2, wherein said shot is an iron-based amorphous spherical particle.

4. The method of claim 1, wherein the short is projected at a metal substance having a Vickers hardness of 950 or less.

5. The method of claim 4, wherein the Vickers hardness of the metal substance is in the range of 650–950.

6. The method of claim 1, wherein a speed of the projecting shot is 100 m/s or less.

7. The method of claim 6, wherein the speed of the projecting shot is in the range of 50–70 m/s.

8. A method for shot peening a metal substance made of steel having a Vickers hardness of 950 or less, comprising projecting shot made of an iron-based amorphous spherical particle at said metal substance, whereby said peened metal substance has a maximum residual compressive stress of 1600 MPa or more and a surface roughness of 5 microns or less.

9. An article treated by the method of claim 1 or 8, said treated article having a maximum residual compressive stress of 1600 MPa or more and a surface roughness of 5 microns or less.

10. Shot having a Vickers hardness in the range of 900–1100 and a Young's modulus of 200,000 MPa or less.

11. The shot of claim 10, wherein the shot has an average particle diameter is 0.02 to 1.5 mm.

* * * * *

UNITED STATES PATENT AND TRADEMARK OFFICE

CERTIFICATE OF CORRECTION

PATENT NO. : 6,658,907 B2
DATED : December 9, 2003
INVENTOR(S) : Akihisa Inoue et al.

It is certified that error appears in the above-identified patent and that said Letters Patent is hereby corrected as shown below:

Column 6,
Line 37, “short” should read -- shot --.

Signed and Sealed this

Second Day of March, 2004

JON W. DUDAS
*Acting Director of the United States Patent and Trademark Office*